US011712711B2

(12) United States Patent
Kuchinski et al.

(10) Patent No.: US 11,712,711 B2
(45) Date of Patent: Aug. 1, 2023

(54) EXPANDABLE PLUNGER HEAD ASSEMBLIES FOR SEALANT DISPENSING GUNS

(71) Applicant: PRC-DeSoto International, Inc., Sylmar, CA (US)

(72) Inventors: Paul Kuchinski, Valley Village, CA (US); Oscar Santillan, Camarillo, CA (US)

(73) Assignee: PRC-DESOTO INTERNATIONAL, INC., Slymar, CA (US)

( * ) Notice: Subject to any disclaimer, the term of this patent is extended or adjusted under 35 U.S.C. 154(b) by 45 days.

(21) Appl. No.: 17/277,648

(22) PCT Filed: Sep. 19, 2019

(86) PCT No.: PCT/IB2019/057887
§ 371 (c)(1),
(2) Date: Mar. 18, 2021

(87) PCT Pub. No.: WO2020/058884
PCT Pub. Date: Mar. 26, 2020

(65) Prior Publication Data

US 2021/0346909 A1 Nov. 11, 2021

Related U.S. Application Data

(60) Provisional application No. 62/733,164, filed on Sep. 19, 2018.

(51) Int. Cl.
*B05C 17/005* (2006.01)
*B65D 83/00* (2006.01)

(52) U.S. Cl.
CPC .. *B05C 17/00596* (2013.01); *B05C 17/00576* (2013.01); *B65D 83/0033* (2013.01)

(58) Field of Classification Search
CPC ..... B05C 17/00596; B05C 17/00576; B05C 17/0133; B65D 83/0033
USPC ..... 222/327, 386, 323–326, 391
See application file for complete search history.

(56) References Cited

U.S. PATENT DOCUMENTS 4,323,177 A * 4/1982 Nielsen ..... B05C 17/00579 222/386
4,694,977 A 9/1987 Graf et al.
4,741,462 A 5/1988 Schneider, Jr.
4,840,293 A 6/1989 Segatz
4,854,485 A 8/1989 Collins
(Continued)

FOREIGN PATENT DOCUMENTS

JP 2003334483 A 11/2003

*Primary Examiner* — Lien M Ngo
(74) *Attorney, Agent, or Firm* — Alan G. Towner

(57) ABSTRACT

Sealant dispensing cartridge assemblies including radially expandable collets are disclosed. A plunger head assembly includes a ram head attached to a plunger rod. As the plunger rod is advanced into the sealant cartridge, the ram head presses against a rear side of a movable plunger against an opposing force created by a sealant contained in the cartridge on a front side of the plunger. As the plunger rod is further advanced, the collet contacts the ram head and radially expands against the inner sidewall of the plunger. The resulting radial force presses the sidewall of the plunger against the inner surface of the cartridge to thereby reduce or prevent unwanted leakage of the sealant around the plunger.

21 Claims, 8 Drawing Sheets

(56) References Cited

U.S. PATENT DOCUMENTS

| | | | | |
|---|---|---|---|---|
| 4,869,403 | A * | 9/1989 | Bruning | B05C 17/00576 222/386 |
| 5,211,312 | A | 5/1993 | Chang | |
| 5,301,835 | A | 4/1994 | Fulks et al. | |
| 5,595,327 | A * | 1/1997 | Dentler | B05C 17/0123 222/391 |
| 6,155,463 | A * | 12/2000 | Dentler | B05C 17/014 222/326 |
| 7,073,691 | B2 | 7/2006 | Rumrill et al. | |
| 7,690,530 | B2 * | 4/2010 | Schneider | B05C 17/00583 222/105 |
| 8,087,550 | B2 | 1/2012 | Schneider et al. | |
| 8,342,371 | B2 * | 1/2013 | Helmenstein | B05C 17/00576 222/386 |
| 8,424,727 | B2 | 4/2013 | Herman et al. | |
| 10,663,893 | B2 * | 5/2020 | Hormann | G03G 15/2025 |
| 2009/0065527 | A1 | 3/2009 | Buck | |
| 2010/0276458 | A1 * | 11/2010 | Buck | B05C 17/00576 222/327 |
| 2017/0035654 | A1 | 2/2017 | Py | |
| 2019/0176183 | A1 | 6/2019 | Horiguchi et al. | |

* cited by examiner

EXPANDABLE PLUNGER HEAD ASSEMBLIES FOR SEALANT DISPENSING GUNS

CROSS-REFERENCE TO RELATED APPLICATION

This application claims priority to U.S. Provisional Patent Application No. 62/733,164, filed on Sep. 19, 2018, which is incorporated herein by reference.

FIELD OF THE INVENTION

The present invention relates to plunger head assemblies for sealant dispensing guns, and more particularly relates to expandable plunger heads for use in such assemblies.

BACKGROUND

Caulks, adhesives and sealants are commonly delivered by a dispensing gun from a cartridge. The dispensing guns often include a plunger on a piston rod to push the material out of the cartridge. Due to space between the outer edge of the plunger head and the inner wall of the cartridge, material may bypass conventional plunger heads and may lead to contamination of the piston rod. If the piston rod is contaminated, the dispensing gun may stop working properly.

SUMMARY OF THE INVENTION

The present invention provides a sealant-dispensing cartridge assembly comprising: a cartridge holder structured and arranged for removable connection to a sealant-dispensing gun; a sealant-containing cartridge inside the cartridge holder including a front cartridge opening extending forward from an open front end of the cartridge holder, and a rear cartridge opening; a plunger slidably mounted inside the sealant-containing cartridge including a front plunger end structured and arranged to contact and apply force against the sealant contained in the cartridge, a rear plunger opening, and a plunger sidewall extending between the front plunger end and rear plunger opening; and a radially expandable plunger head assembly mounted on a plunger rod and at least partially inserted through the rear plunger opening structured and arranged to apply outward radial force against the plunger sidewall when the plunger rod is advanced forward inside the sealant-containing cartridge and the plunger-head assembly presses against the plunger to apply the force against the sealant.

The present invention also provides a sealant cartridge assembly comprising: a sealant-containing cartridge including a front cartridge opening and a rear cartridge opening; a plunger slidably mounted inside the sealant-containing cartridge including a front plunger end structured and arranged to contact and apply force against the sealant contained in the cartridge, a rear plunger opening, and a plunger sidewall extending between the front plunger end and rear plunger opening; and a radially expandable plunger head assembly mounted on a plunger rod and at least partially inserted through the rear plunger opening structured and arranged to apply outward radial force against the plunger sidewall when the plunger rod is advanced forward inside the sealant-containing cartridge and the plunger-head assembly presses against the plunger to apply the force against the sealant.

The present invention further provides a radially expandable plunger head assembly for use in a sealant cartridge assembly including a sealant-containing cartridge and a plunger slidably mounted inside the sealant-containing cartridge. The plunger head assembly comprises: a ram head slidingly mounted on a front end of a plunger rod having a front face structured and arranged to contact a front plunger end, and a rear collet engagement surface; and a radially expandable collet mounted on the front end of the plunger rod having at least one radially expandable finger structured and arranged to contact the collet engagement surface of the ram head and move radially outward toward a sidewall of the plunger when the plunger rod is advanced forward inside the sealant-containing cartridge.

DETAILED DESCRIPTION

Figure 1:
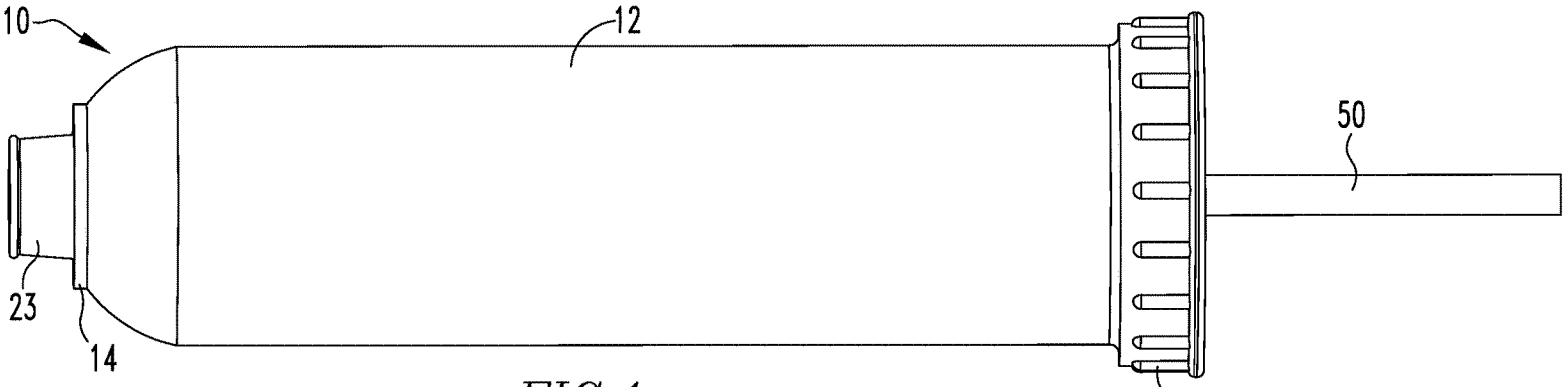
FIG. 1 is a side view of a sealant dispensing cartridge assembly of the present invention.
Figure 2:
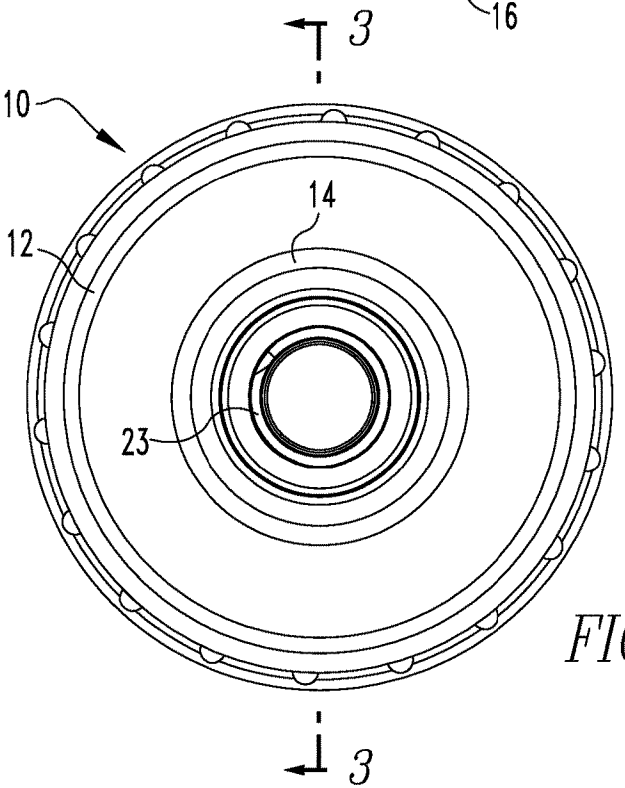
FIG. 2 is a front view of the sealant dispensing cartridge assembly of FIG. 1.
Figure 3:
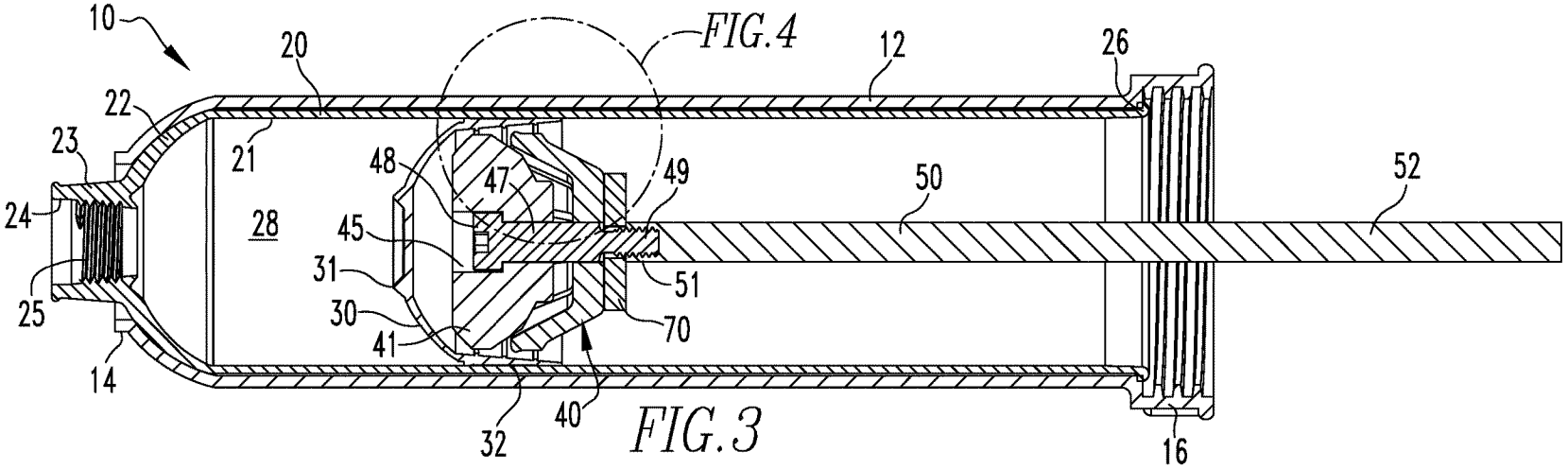
FIG. 3 is a side sectional view of the sealant dispensing cartridge assembly taken through line 3-3 of FIG. 2.

FIGS. 1-13 illustrate features of a sealant dispensing cartridge assembly 10 of the present invention. The cartridge assembly 10 includes a cartridge holder 12 having an open front end 14 and a standard threaded rear end 16. As shown in FIGS. 1-3, a sealant cartridge 20 is removably inserted inside the cartridge holder 12. The sealant cartridge 20 has a cylindrical inner wall 21, a rounded front shoulder 22, and a front neck 23. A front cartridge opening 24 is provided in the front neck 23 and has standard internal threads 25. The front neck 23 of the sealant cartridge 20 extends through the open front end 14 of the cartridge holder 12. The sealant cartridge 20 includes a collared rear cartridge opening 26. The interior volume of the sealant cartridge 20 defines a sealant chamber that may be filled with various known types of sealants. As used herein, the term "sealants" includes known types of sealants as well as adhesives and caulks.

As shown most clearly in FIGS. 3, 4, 9 and 10, a plunger 30 is slidably inserted in the sealant cartridge 20 in contact with the cylindrical inner wall 21. The plunger 30 includes a front plunger end 31 and plunger sidewall 32. The sidewall 32 has an inner surface 33 and an outer surface 34. The plunger sidewall 32 includes a front wiper ring 35 and a rear wiper ring 36. A rear plunger opening 38 is provided in the plunger 30.

As shown in FIGS. 3-7 and 9-13, the sealant dispensing cartridge assembly 10 includes a radially expandable plunger assembly 40. The plunger assembly 40 includes a ram head 41 having a front face 42, rear face 43 and conical collet engagement surface 44. A circular front opening 45 is provided in the front face 42 of the ram head 41, and a smaller rear opening 46 is provided through the rear face 43 of the ram head 41. A ram bolt 47 is inserted through the front opening 45 of the ram head 41. The ram bolt 47 has a front bolt head 48 and a threaded rear end 49. The diameter of the front bolt head 48 is smaller than the diameter of the front opening 45, but larger than the diameter of the rear opening 46.

Figure 9:
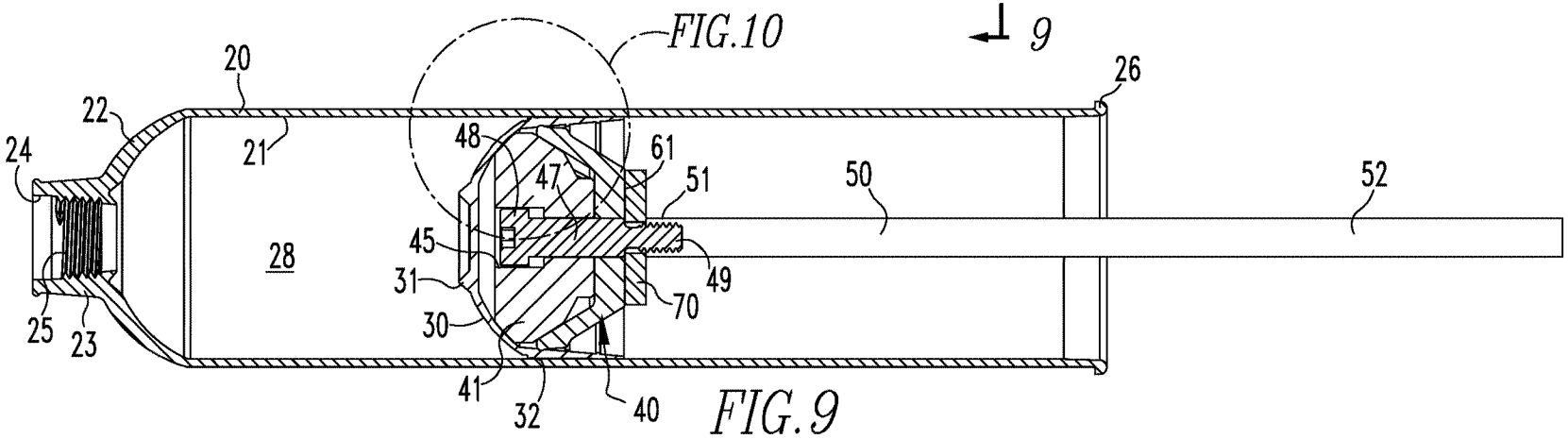
FIG. 9 is a side-sectional view taken through line 9-9 of FIG. 8.
Figure 11:
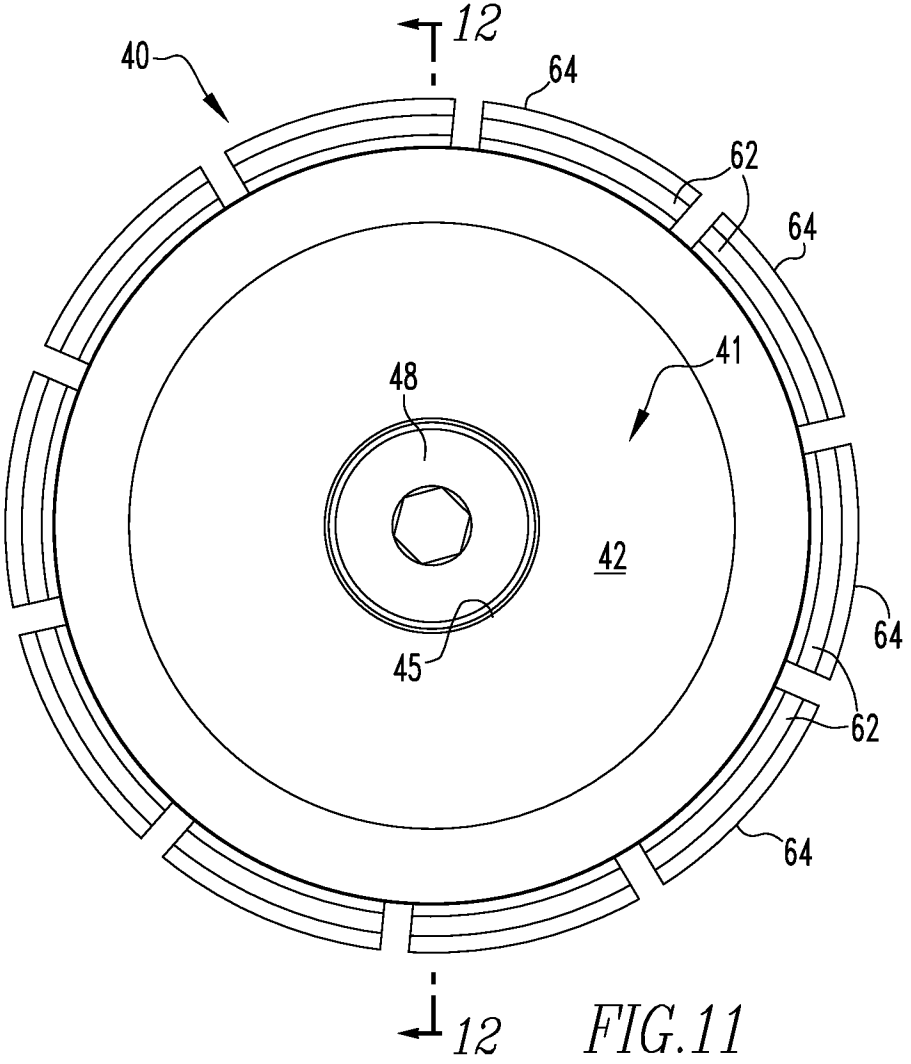
FIG. 11 is a front view of the radially expandable plunger head assembly with the collet in its radially expanded position.

As shown in FIGS. 3 and 9, a plunger rod 50 extends into the sealant cartridge 20. The plunger rod 50 includes an internally threaded front end 51 and a standard rear end 52 that extends rearwardly outward from the sealant cartridge 20 and cartridge holder 12.

As shown most clearly in FIGS. 3, 4, 9 and 10, a radially expandable collet 60 is mounted on the ram bolt 47. The collet 60 includes a rear base surface 61 with radially expandable fingers 62 extending forwardly therefrom. Each radially expandable finger 32 has a ram engaging inner surface 63 and a radially outermost contact ring segment 64. A central hole 66 extends through the rear base surface 61 of the collet 60. As shown most clearly in FIGS. 3 and 9, the ram bolt 47 is threaded on the plunger rod 50 through engagement of the threaded rear end 49 of the bolt and the internally threaded front end 51 of the plunger rod. Any other suitable type of mounting arrangement between the ram bolt 47 and plunger rod 50 may be used, such as pins, mechanical fasteners, press fits, adhesives and the like. A washer 70 surrounds the ram bolt 47 and contacts the front end 51 of the plunger rod 50. The ram bolt 47, plunger rod 50 and washer 70 are secured together for axial movement within the sealant cartridge 20.

Figure 4:
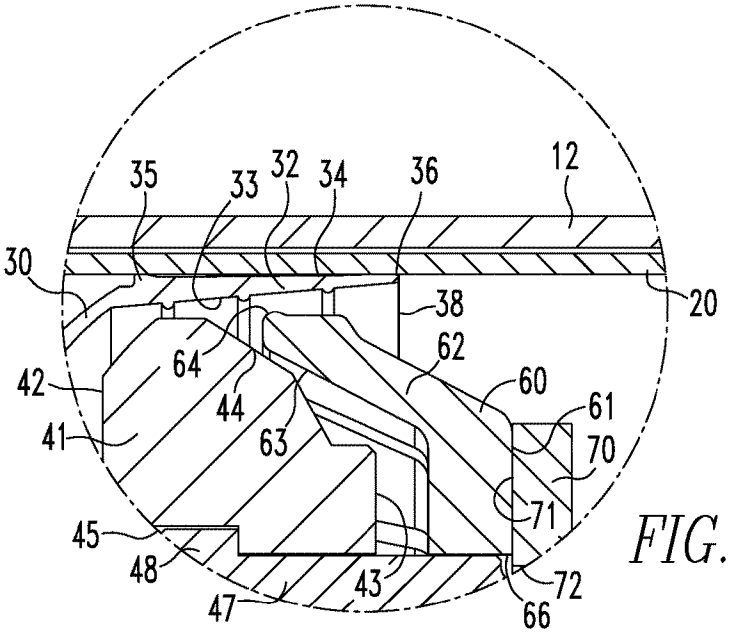
FIG. 4 is a magnified side-sectional view of a portion of FIG. 3.
Figure 5:
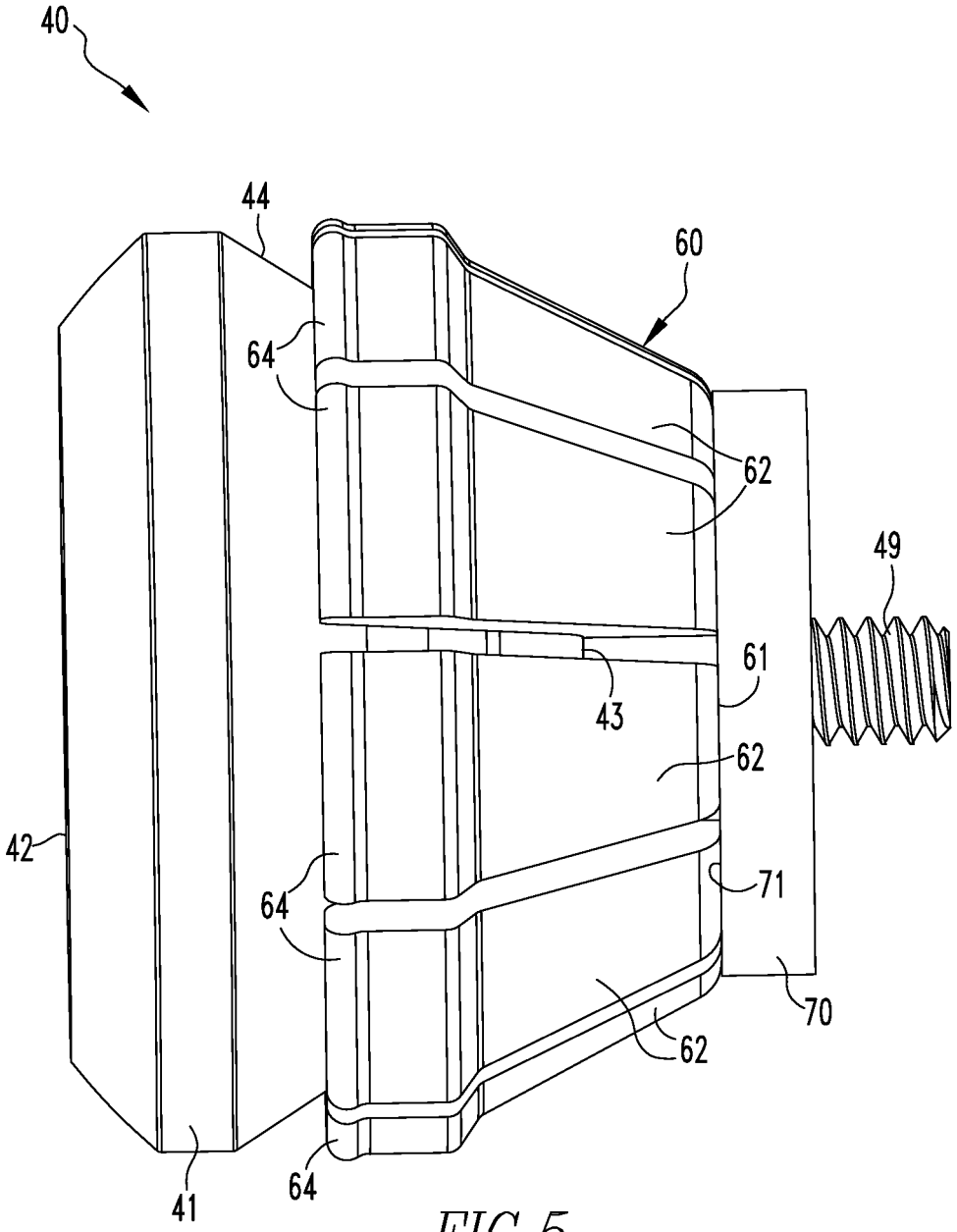
FIG. 5 is a side view of a radially expandable plunger head assembly of the present invention with a collet in its retracted position.
Figure 7:
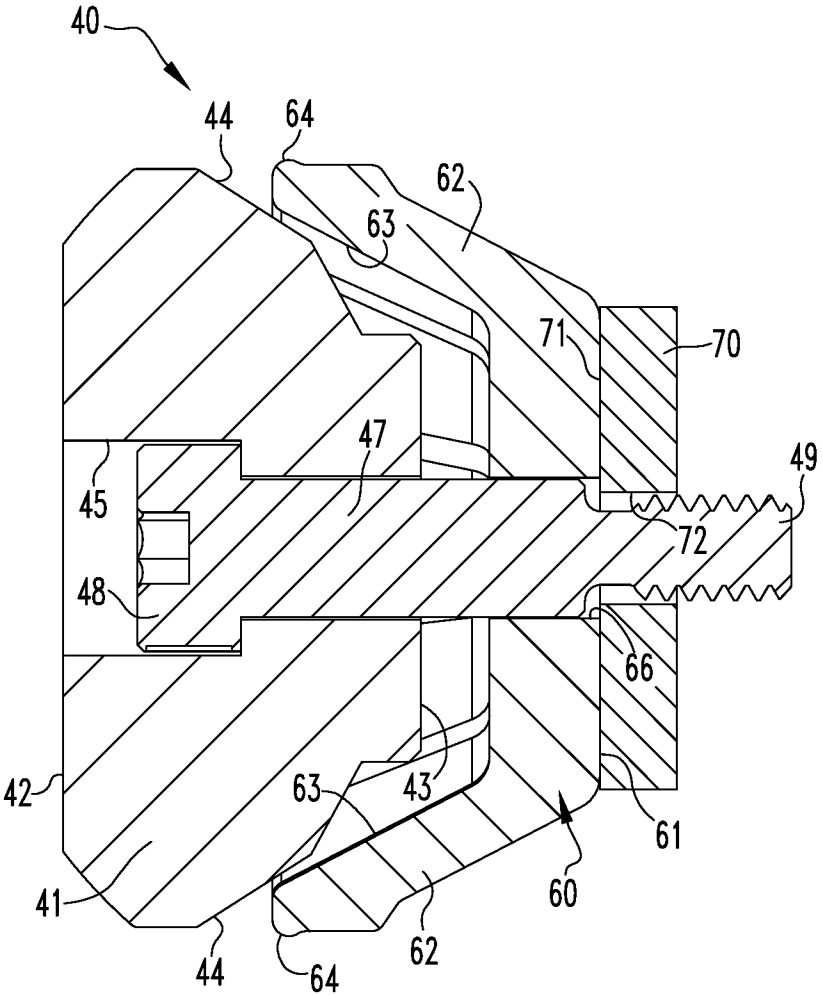
FIG. 7 is a side-sectional view taken through line 7-7 of FIG. 6.
Figure 6:
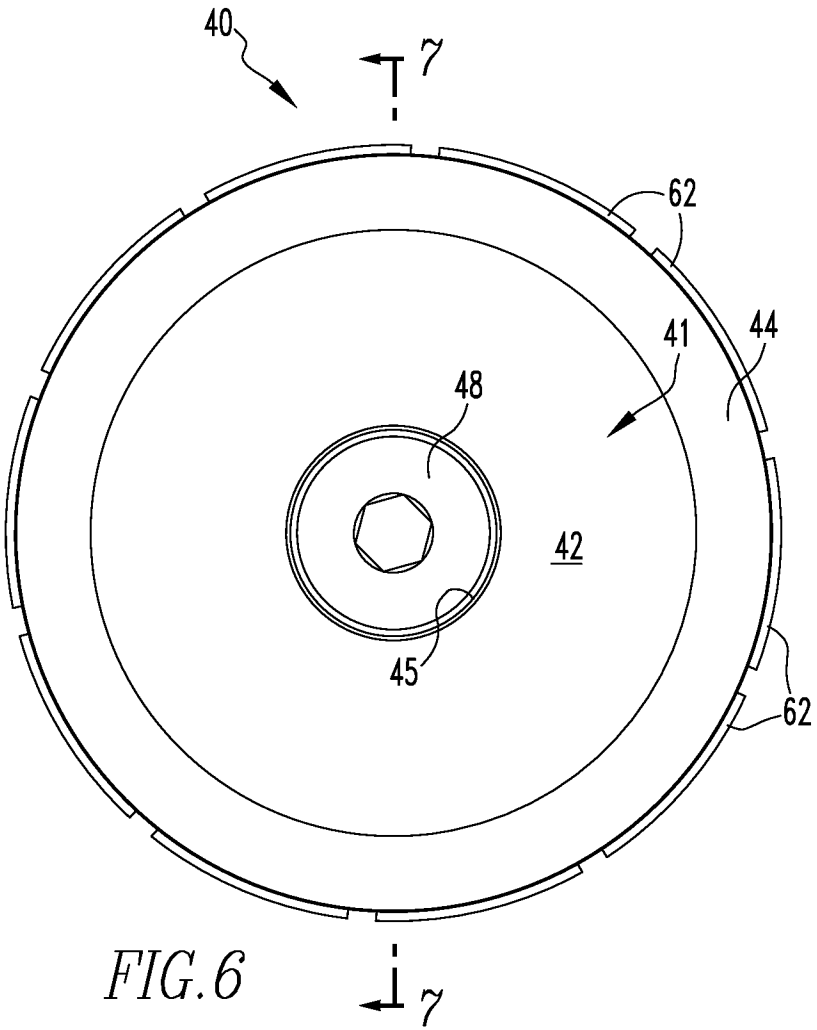
FIG. 6 is a front view of the radially expandable plunger head assembly of FIG. 5.
Figure 8:
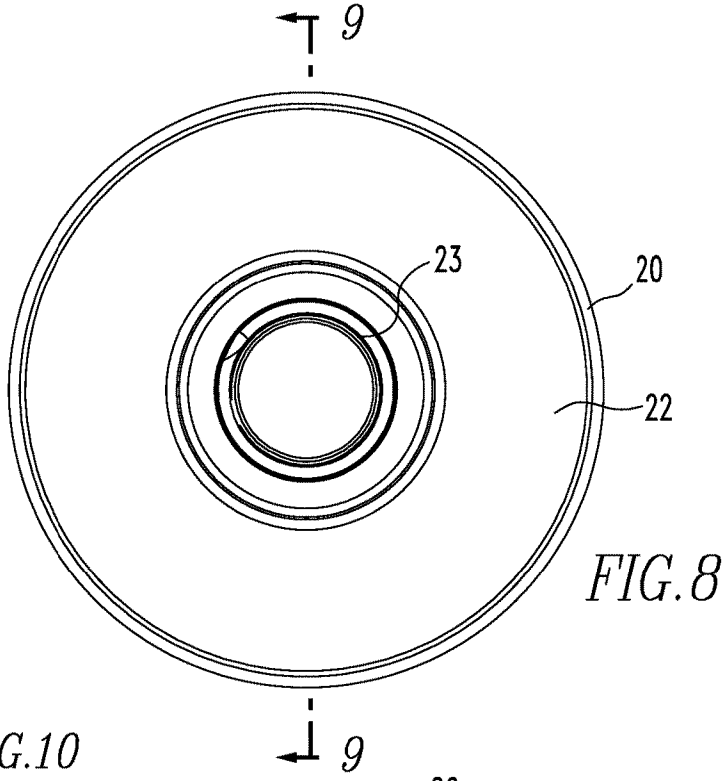
FIG. 8 is a front view of a sealant cartridge and expandable plunger head assembly.

FIGS. 3-7 illustrate the radially expandable plunger head assembly 40 in a retracted position, while FIGS. 9-12 illustrate the plunger head assembly 40 in a radially expanded position. As shown in FIGS. 3 and 4, the ram head 41 is rearwardly spaced from the front end 31 of the plunger 30. In this position, the radially expandable collet 60 is in its retracted position in which the bolt head 48 is fully inserted in the front opening 45 of the ram head 41. As shown most clearly in FIG. 4, the ram engaging surface 63 of each radially expandable finger 62 of the collet 60 does not contact the conical collet engagement surface 44 of the ram head 41 in the retracted position.

Figure 10:
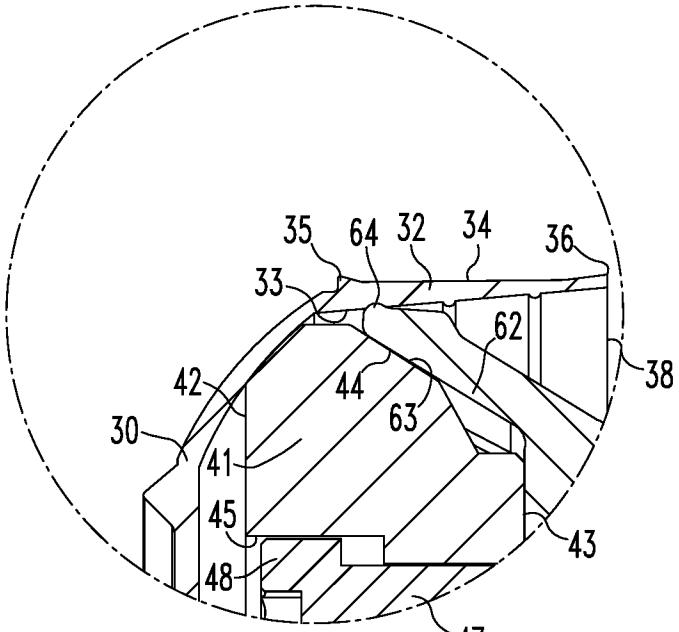
FIG. 10 is a magnified side-sectional view of a portion of FIG. 9.
Figure 12:
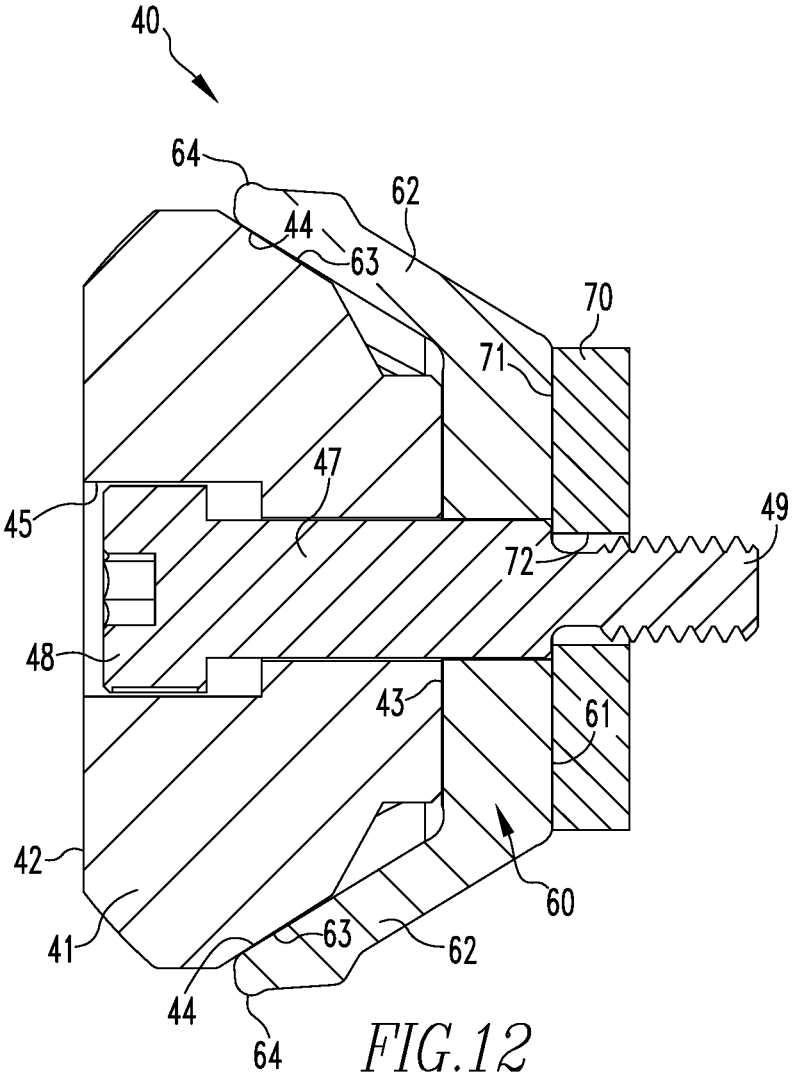
FIG. 12 is a side-sectional view taken through line 12-12 of FIG. 11.
Figure 13:
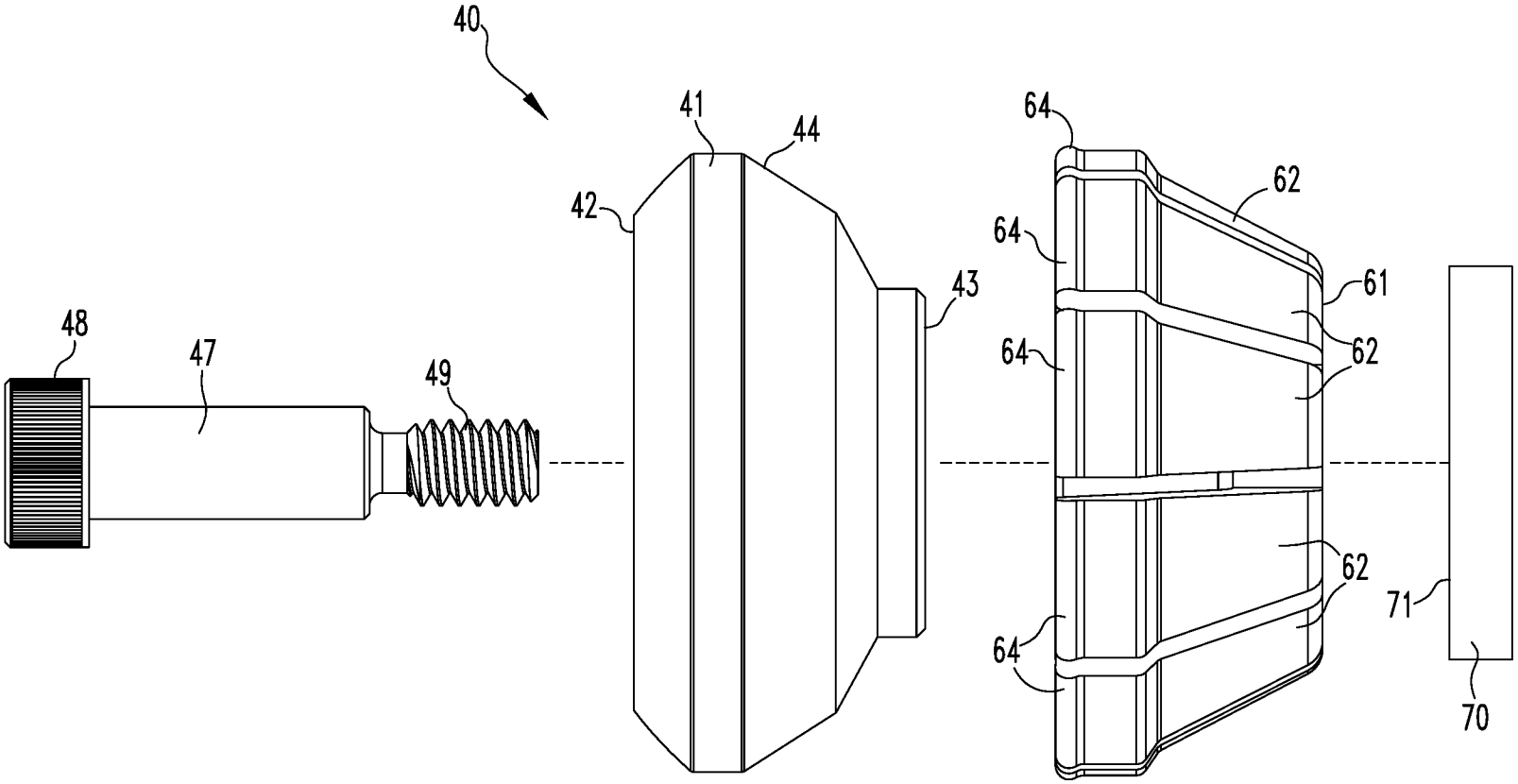
FIG. 13 is an exploded side view illustrating components of the radially expandable plunger head assembly.

As shown in FIGS. 9 and 10, when the plunger rod 50 is pushed into the sealant cartridge 20 against the force of a sealant contained in the sealant chamber 28, the washer 70 attached to the front end 51 of the plunger rod 50 presses against the rear base surface 61 of the collet 60, which causes the ram engaging inner surfaces 63 of the radially expandable fingers 62 to contact the rear conical collet engagement surface 44 of the ram head 41. As shown in FIGS. 9 and 10, opposing force provided by the sealant in the chamber 28 against the front end 31 of the plunger 30 resists the forward movement of the plunger 30 while the ram head 41 continues to move inside the plunger 30 until its front end 62 contacts the inner surface of the plunger 30. Continued movement of the plunger rod 50 causes the ram bolt 47 to travel forward toward the front opening 45 of the ram head 41. During such forward movement of the ram bolt 47, the washer 70 pushes against the rear base surface 61 of the collet 60, causing the ram engaging inner surface 63 of each finger 62 to contact the conical collet engagement surface 44 of the ram head 41, thereby forcing the fingers 62 radially outward. The contact ring segment 64 of each finger 62 is forced radially outward to thereby contact the inner surface 33 of the sidewall 32 of the plunger 30.

As shown most clearly in FIG. 10, each contact ring segment 64 of the collet 60 presses the sidewall 32 of the plunger 30 radially outward. Such outward radial force may force the front wiper ring 35 and/or rear wipe ring 36 radially outward to provide an increased sealing force against the inner wall 21 of the sealant cartridge 20. When the contact ring segments 64 are forced radially outward, they may contact the plunger sidewall 32 at any desired location(s) along the axial length of the plunger 30. Such additional sealing force may reduce or eliminate unwanted leakage of the sealant contained in the cartridge around the outer periphery of the plunger 30. Thus, outward expansion of the collet 60 creates a tighter seal between the plunger 30 and inner cartridge wall 21 to prevent sealant bypassing the plunger head assembly. The outward expansion during application of the sealant allows the plunger head assembly 40 to provide an optimal seal with different plunger designs and cartridges.

The collet 60 may expand to have a radially extended diameter greater than the inner diameter of the sidewall 32 of the plunger 30, but less than or substantially equal to the inner diameter of the inner wall 21 of the cartridge 20. The collet 60 may expand to a range of diameters to allow for the use of different sized/designed sealant plungers and apply necessary pressure between the plunger and the inner wall of the cartridge to prevent sealant bypass.

When the collet 60 is in its radially retracted position, it has a retracted outer diameter, and when the collet 60 is in its radially expanded position, it has an expanded outer diameter. The expanded outer diameter is typically at least 3 percent greater than the retracted outer diameter, for example, at least 4 percent greater, or at least 5 percent greater. The expanded outer diameter of the collet 60 is typically less than 8 percent greater than the retracted outer diameter, for example, less than 7 percent greater, or less than 6 percent greater. The expanded outer diameter of the collet 60 may typically range from 3 to 8 percent greater than the retracted outer diameter, for example, from 4 to 7 percent greater, or from 5 to 6 percent greater.

For certain sealant cartridge 20 and plunger 30 sizes, the expanded outer diameter of the collet 60 may range from 30 to 50 millimeters, for example, from 35 to 40 millimeters, or from 37 to 39 millimeters, or from 37.5 to 38.5 millimeters, or from 37.7 to 38.0 millimeters. However, the expanded outer diameter may be adjusted for other sizes of sealant cartridges and plungers.

In the figures, the collet 60 comprises ten contact ring segments 64, but any other suitable number of segments may be used, e.g. four, six, eight, twelve or more segments. Alternatively, the collet 60 may comprise a single segment. The segments 64 may be equally sized and spaced, or any other suitable arrangement may be used. For example, adjacent segments may have different radial lengths and/or widths.

The expandable plunger head assembly 40 may be used with conventional powered sealant dispensing guns such as battery-powered, electrically powered and pneumatically powered dispensing guns (not shown) or may be used with conventional manual mechanical style sealant dispensing guns (not shown).

The components of the expandable plunger head assembly 40 may be made of any suitable materials such as plastics, metals and the like. For example, the ram head 41 may be made of a rigid material such as aluminum, stainless steel, polypropylene or the like, and the collet 60 may be made of a semi-rigid or flexible material such as nylon, polypropylene, polyethylene and the like.

For purposes of the detailed description, it is to be understood that the invention may assume various alternative variations and step sequences, except where expressly specified to the contrary. Moreover, other than in any operating examples, or where otherwise indicated, all numbers such as those expressing values, amounts, percentages, ranges, subranges and fractions may be read as if prefaced by the word "about," even if the term does not expressly appear. Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques. Where a closed or open-ended numerical range is described herein, all numbers, values, amounts, percentages, subranges and fractions within or encompassed by the numerical range are to be considered as being specifically included in and belonging to the original disclosure of this application as if these numbers, values, amounts, percentages, subranges and fractions had been explicitly written out in their entirety.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

As used herein, "including," "containing" and like terms are understood in the context of this application to be synonymous with "comprising" and are therefore open-ended and do not exclude the presence of additional undescribed or unrecited elements, materials, ingredients or method steps. As used herein, "consisting of" is understood in the context of this application to exclude the presence of any unspecified element, ingredient or method step. As used herein, "consisting essentially of" is understood in the context of this application to include the specified elements, materials, ingredients or method steps "and those that do not materially affect the basic and novel characteristic(s)" of what is being described.

As used herein, the terms "on," "onto," "applied on," "applied onto," "formed on," "deposited on," "deposited onto," mean formed, overlaid, deposited, or provided on but not necessarily in contact with the surface. For example, an electrodepositable coating composition "deposited onto" a substrate does not preclude the presence of one or more other intervening coating layers of the same or different composition located between the electrodepositable coating composition and the substrate.

Whereas specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A sealant-dispensing cartridge assembly comprising:

a cartridge holder structured and arranged for removable connection to a sealant-dispensing gun;

a sealant-containing cartridge inside the cartridge holder including a front cartridge opening extending forward from an open front end of the cartridge holder, and a rear cartridge opening;

a plunger slidably mounted inside the sealant-containing cartridge including a front plunger end structured and arranged to contact and apply force against the sealant contained in the cartridge, a rear plunger opening, and a plunger sidewall extending between the front plunger end and rear plunger opening; and a radially expandable plunger head assembly mounted on a plunger rod and at least partially inserted through the rear plunger opening structured and arranged to apply outward radial force against the plunger sidewall when the plunger rod is advanced forward inside the sealant-containing cartridge and the plunger-head assembly presses against the plunger to apply the force against the sealant, wherein the radially expandable plunger head assembly comprises:

a ram head slidingly mounted on a front end of the plunger rod having a front face structured and arranged to contact the front plunger end, and a rear collet engagement surface; and a radially expandable collet mounted on the front end of the plunger rod structured and arranged to contact the collet engagement surface of the ram head and move radially outward against the plunger sidewall when the plunger rod is advanced forward inside the sealant-containing cartridge.

2. The sealant dispensing cartridge assembly of claim 1, wherein the radially expandable collet comprises at least one radially expandable finger.

3. A sealant cartridge assembly comprising:

a sealant-containing cartridge including a front cartridge opening and a rear cartridge opening;

a plunger slidably mounted inside the sealant-containing cartridge including a front plunger end structured and arranged to contact and apply force against the sealant contained in the cartridge, a rear plunger opening, and a plunger sidewall extending between the front plunger end and rear plunger opening; and a radially expandable plunger head assembly mounted on a plunger rod and at least partially inserted through the rear plunger opening structured and arranged to apply outward radial force against the plunger sidewall when the plunger rod is advanced forward inside the sealant-containing cartridge and the plunger-head assembly presses against the plunger to apply the force against the sealant, wherein the radially expandable plunger head assembly comprises:

a ram head slidingly mounted on a front end of the plunger rod having a front face structured and arranged to contact the front plunger end, and a rear collet engagement surface; and a radially expandable collet mounted on the front end of the plunger rod structured and arranged to contact the collet engagement surface of the ram head and move radially outward against the plunger sidewall when the plunger rod is advanced forward inside the sealant-containing cartridge.

4. The sealant cartridge assembly of claim 3, wherein the radially expandable collet comprises at least one radially expandable finger.

5. The sealant cartridge assembly of claim 4, wherein the at least one radially expandable finger of the collet contacts the plunger sidewall at an axial location adjacent to an external wiper ring of the plunger.

6. The sealant cartridge assembly of claim 5, wherein the plunger comprises a front wiper ring, and the at least one radially expandable finger of the collet contacts the plunger at an axial location adjacent to the front wiper ring.

7. The sealant cartridge assembly of claim 5, wherein the plunger comprises a front wiper ring and a rear wiper ring, and the at least one radially expandable finger of the collet contacts the plunger at an axial location between the front and rear wiper rings.

8. A radially expandable plunger head assembly for use in a sealant cartridge assembly including a sealant-containing cartridge and a plunger slidably mounted inside the sealant-containing cartridge, the plunger head assembly comprising:

a ram head slidingly mounted on a front end of a plunger rod having a front face structured and arranged to contact a front plunger end, and a rear collet engagement surface; and a radially expandable collet mounted on the front end of the plunger rod having at least one radially expandable finger structured and arranged to contact the collet engagement surface of the ram head and move radially outward toward a sidewall of the plunger when the plunger rod is advanced forward inside the sealant-containing cartridge.

9. The radially expandable plunger head assembly of claim 8, wherein the at least one radially expandable finger of the collet comprises a ram-engaging inner surface and an outer contact ring segment.

10. The radially expandable plunger head assembly of claim 9, wherein the collet comprises a rear base surface and the at least one radially expandable finger extends forward from the base surface.

11. The radially expandable plunger head assembly of claim 10, wherein the collet comprises at least three of the radially expandable fingers.

12. The radially expandable plunger head assembly of claim 10, wherein the rear base of the collet is secured to the end of the plunger rod by a bolt extending through a central hole in the base, and the ram head is slidingly mounted on the bolt.

13. The radially expandable plunger head assembly of claim 8, wherein the at least one radially expandable finger of the collet comprises a flexible material.

14. The radially expandable plunger head assembly of claim 13, wherein the flexible material comprises plastic.

15. The radially expandable plunger head assembly of claim 14, wherein the plastic comprises nylon, polypropylene or polyethylene.

16. The radially expandable plunger head assembly of claim 8, wherein the radially expandable collet is expandable from a radially retracted position having a retracted outer diameter to a radially expanded position having an expanded outer diameter, and the expanded outer diameter is at least 3 percent greater than the retracted outer diameter.

17. The radially expandable plunger head assembly of claim 16, wherein the expanded outer diameter is less than 8 percent greater than the retracted outer diameter.

18. The radially expandable plunger head assembly of claim 16, wherein the expanded outer diameter is from 3 to 8 percent greater than the retracted outer diameter.

19. The radially expandable plunger head assembly of claim 16, wherein the expanded outer diameter is from 35 to 40 millimeters.

20. The radially expandable plunger head assembly of claim 16, wherein the expanded outer diameter is from 37 to 39 millimeters.

21. The radially expandable plunger head assembly of claim 16, wherein the at least one radially expandable finger of the collet is structured and arranged to deform a portion of the plunger sidewall radially outward when the collet is in the radially expanded position.

* * * * *